US012222184B1

(12) United States Patent
Liu

(10) Patent No.: US 12,222,184 B1
(45) Date of Patent: Feb. 11, 2025

(54) RAPID ACCESS DEVICE FOR COMPOUND BOW RELEASE AIDS

(71) Applicant: Xinyi Liu, Guangzhou (CN)

(72) Inventor: Xinyi Liu, Guangzhou (CN)

( * ) Notice: Subject to any disclaimer, the term of this patent is extended or adjusted under 35 U.S.C. 154(b) by 0 days.

(21) Appl. No.: 18/824,904

(22) Filed: Sep. 5, 2024

(30) Foreign Application Priority Data

Aug. 9, 2024 (CN) ..... 202421920258.9

(51) Int. Cl.
*F41B 5/14* (2006.01)
*F41B 5/18* (2006.01)

(52) U.S. Cl.
CPC ..... *F41B 5/1469* (2013.01)

(58) Field of Classification Search
CPC ..... F41B 5/14; F41B 5/1469
See application file for complete search history.

(56) References Cited

U.S. PATENT DOCUMENTS 5,123,396 A * 6/1992 Shepley ..... F41B 5/066 124/25.7
6,889,683 B1 * 5/2005 Smith ..... F41B 5/14 124/87
7,775,201 B2 * 8/2010 Cooper ..... F41B 5/14 224/916
8,065,994 B2 * 11/2011 Holmberg ..... F41B 5/14 124/88
8,596,256 B2 * 12/2013 McPherson ..... F41B 5/066 224/916
10,845,154 B2 11/2020 Griggs
11,131,523 B2 * 9/2021 Otten ..... F41B 5/148
2013/0288743 A1 * 10/2013 Hunt ..... F16M 11/2014 29/434
2023/0003483 A1 * 1/2023 Otten ..... F41B 5/14
2024/0035775 A1 * 2/2024 Otten ..... F41B 5/14

FOREIGN PATENT DOCUMENTS

CN 111854522 A 10/2020

* cited by examiner

*Primary Examiner* — John A Ricci
(74) *Attorney, Agent, or Firm* — Ricky Lam

(57) ABSTRACT

Disclosed is a rapid access device for compound bow release aids. First regulation holes and second regulation holes distributed in an array manner are arranged on a modular mounting mainboard, and an adsorption piece is arranged. Both a first adsorption piece and a second adsorption piece are strong magnetic components, and the second adsorption piece is mounted at a position above the second regulation holes to adsorb a hook part of a compound bow release aid. An expansion hole plate is further mounted at a position of the first regulation holes of the present disclosure, and a position of the expansion hole plate can be adjusted in horizontal, vertical and rotational directions. The first adsorption piece is mounted on the expansion hole plate, such that the first adsorption piece is capable of adsorbing metal components of triggers or switches of most compound bow release aids.

10 Claims, 10 Drawing Sheets

RAPID ACCESS DEVICE FOR COMPOUND BOW RELEASE AIDS

TECHNICAL FIELD

The present disclosure relates to the technical field of auxiliary access devices for sports equipment, and particularly relates to a rapid access device for compound bow release aids.

BACKGROUND

A compound bow release aid is a tool used for controlling release of compound bows, and includes a trigger, a switch and a hook. Generally, when the trigger is pulled, the hook is opened or closed to achieve the release of a compound bow. An access device for compound bow release aids in the prior art includes a release bag, a release sleeve, and a release access board, where the release bag and the release sleeve are most basic storage components, but both the components have defects of slow access to the compound bow release aid and susceptibility to dust accumulation, thereby making it difficult to clean. The release access board is a component popular on the market that allows for fast access to the compound bow release aids. However, fixing components such as strong magnets and hanging plates are need to achieve the purpose of fixing. The compound bow release aids currently on the market vary significantly in specifications and sizes, and the triggers and the switches may be designed by manufacturers to be located at different positions to meet customized needs of different people. As a result, an adjustable range of a strong magnetic fixing mechanism on the release access board needs to be compatible with structural designs of most compound bow release aids. However, the release access boards currently on the market are only suitable for a small number of the compound bow release aids. New release access boards need to be custom-made for new compound bow release aids with different structural designs, which is very inconvenient. Furthermore, the release access boards in the prior art lack effective gear position mechanisms for fixing knobs of the compound bow release aids, and users rely on their feeling when tightening or loosening the knobs by rotating, such that precision is relatively poor.

SUMMARY

In order to overcome the above defects in the prior art, an objective of the present disclosure is to provide a rapid access device for compound bow release aids, so as to solve the technical problems mentioned in the Background.

In order to solve the technical problems, the present disclosure is achieved by means of the following technical solution:

A rapid access device for a compound bow release aid, including a modular mounting mainboard, an anti-falling support plate, an anti-falling locking column, first regulation holes, second regulation holes and an adsorption piece that are sequentially mounted on the modular mounting mainboard, where an anti-falling knob is rotatably mounted on the anti-falling support plate, the adsorption piece includes a first adsorption piece and a second adsorption piece, an expansion hole plate is mounted at a position of the first regulation holes, the first adsorption piece is mounted on the expansion hole plate, the second adsorption piece is mounted at a position above the second regulation holes, and a gear position adjustment assembly capable of adjusting a position of the anti-falling knob relative to the anti-falling support plate is further mounted between the anti-falling knob and the anti-falling support plate.

Specifically, the expansion hole plate includes expansion fixing holes and adjustment fixing holes, where the expansion fixing holes are configured for fitting with the first regulation holes during mounting, and the adjustment fixing holes are configured for fitting with the first adsorption piece during mounting; the first adsorption piece includes a first adsorption head, a first lock screw, and a first lock nut; and the second adsorption piece includes a second adsorption head, a second lock screw, and a second lock nut, where both the first adsorption head and the second adsorption head are strong magnetic components.

Specifically, the gear position adjustment assembly includes gear position holes and a spring bead, a bead groove is formed at an upper end of the anti-falling support plate, and the spring bead is mounted in the bead groove; and a plurality of the gear position holes are formed at a lower end of the anti-falling knob, and an output end of the spring bead is capable of abutting against the corresponding gear position hole when the anti-falling knob rotates.

Specifically, third regulation holes and fourth regulation holes are further included, where the third regulation holes are located on a side of the first regulation holes, the fourth regulation holes are located on a side of the second regulation holes, the third regulation holes are configured for fitted adjustment and mounting of the anti-falling locking column, and the fourth regulation holes are configured for the fitted adjustment and mounting of the anti-falling support plate.

Specifically, the fourth regulation holes include a plurality of fixing holes arranged horizontally, a support plate fixing hole is formed in the anti-falling support plate, and a bolt penetrates through the support plate fixing hole and the corresponding fourth regulation hole to fix the anti-falling support plate on the modular mounting mainboard; and a first shaft hole is formed on a side of the anti-falling support plate in a penetrating manner, a second shaft hole is formed at a position where the anti-falling knob corresponds to the first shaft hole, and a damping rotating shaft sequentially penetrates through the first shaft hole and the second shaft hole to complete damping-type rotation mounting of the anti-falling knob and the anti-falling support plate.

Specifically, the first adsorption piece further includes a height adjusting washer, and the height adjusting washer is arranged between the first adsorption head and the expansion hole plate and is sleeved on an outer side of the first lock screw.

Specifically, the damping rotating shaft includes a damping screw, damping gaskets, an outer damping groove, an inner damping groove, and a damping nut; the outer damping groove is formed on an outer side of the anti-falling knob, and the inner damping groove is formed on an inner side of the anti-falling support plate; a plurality of the damping gaskets are respectively located at positions between the outer damping groove, the inner damping groove, the anti-falling support plate and the anti-falling knob; and the damping screw sequentially penetrates through the first shaft hole, the second shaft hole, and the corresponding damping gasket to complete the mounting of the damping rotating shaft.

Specifically, the anti-falling locking column includes a lock screw, a support rubber sleeve and a locking nut, and an embedded groove is formed in the support rubber sleeve and is configured for fitting an edge or a middle portion protruding on the main body of the compound bow release aid in an embedded manner.

Specifically, either of the adjustment fixing holes is one of a long slot hole, a curved slot hole, or a V-shaped slot hole.

Specifically, the anti-falling support plate is provided with an arc-shaped protrusion designed to lift an arc-shaped part of a main body of a compound bow release aid.

Compared with the prior art, the present disclosure has the beneficial effects as follows:

The first regulation holes and the second regulation holes distributed in an array manner are arranged on the modular mounting mainboard, and the adsorption piece is arranged. Both the first adsorption piece and the second adsorption piece are strong magnetic components, and the second adsorption piece is mounted at a position above the second regulation holes to adsorb a hook part of a compound bow release aid. To solve the problem that triggers and switches of compound bow release aids designed by different manufacturers may be located at different positions, the expansion hole plate is further mounted at a position of the first regulation holes of the present disclosure, and a position of the expansion hole plate can be adjusted in horizontal, vertical and rotational directions. The first adsorption piece is mounted on the expansion hole plate, such that the first adsorption piece is capable of adsorbing metal components of triggers or switches of most compound bow release aids. Combined with support by both the anti-falling support plate and the anti-falling locking column in a middle part of the modular mounting mainboard, and rotational locking of the compound bow release aid through the anti-falling knob, the present disclosure is capable of preventing the compound bow release aid from falling, and locking the compound bow release aid tightly by means of multi-point coverage in both horizontal and vertical directions and on an outer side. In use, after switch and hook positions of the compound bow release aid corresponding to the first adsorption piece and the second adsorption piece are pre-adjusted through the first regulation holes and the second regulation holes, the user only needs to simply align the compound bow release aid roughly and directly place the compound bow release aid into the rapid access device for automatic adsorption, and then to tighten the anti-falling knob to lock and store. To take out the compound bow release aid, the user only needs to rotate the anti-falling knob counterclockwise to unlock and take out the compound bow release aid, which is very convenient in use. The anti-falling knob is further provided with a gear position adjustment mechanism, and the gear position adjustment mechanism, through cooperation of the spring bead and the gear position holes, enables a user to know an angle of rotation when rotating the anti-falling knob, thereby facilitating quick locking and unlocking of the anti-falling knob.

Figure 1:
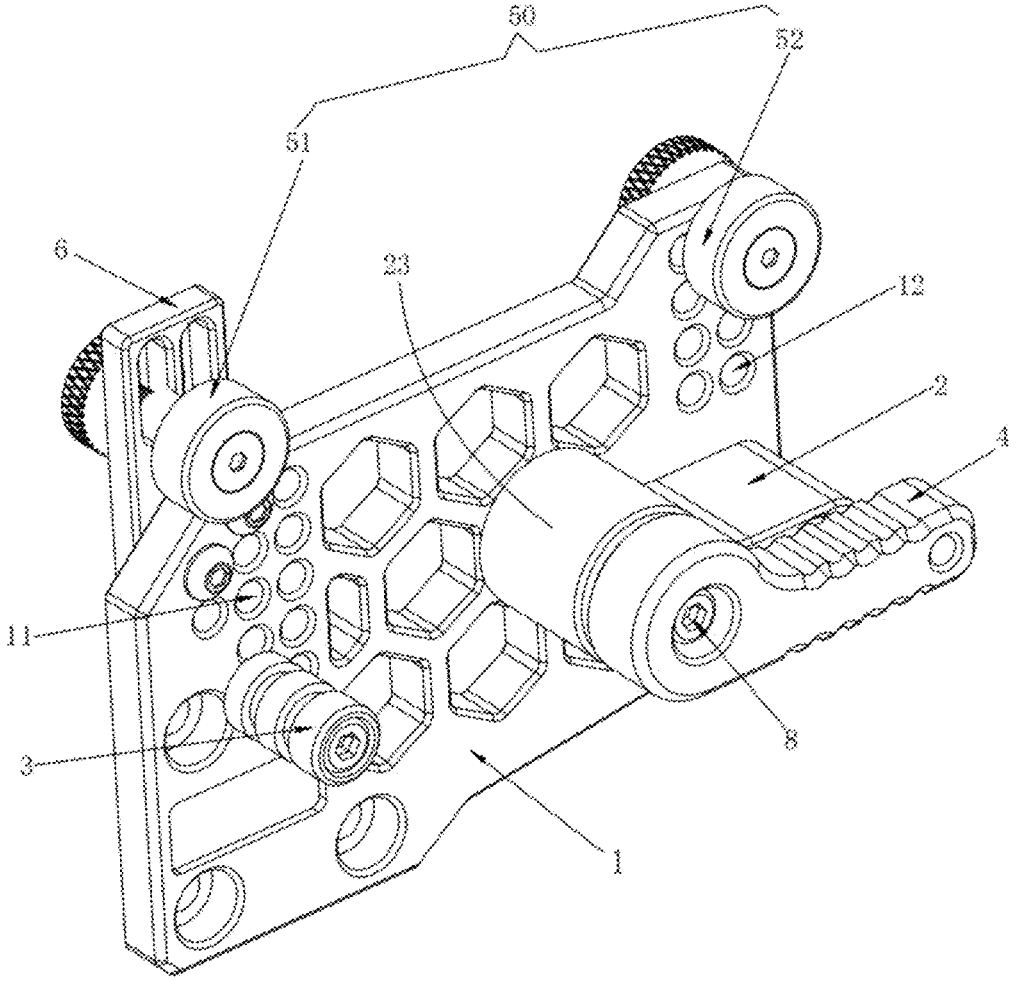
FIG. 1 is a three-dimensional schematic diagram I of an overall structure of an access device of the present disclosure.

Reference numerals in the figures: modular mounting mainboard 1, anti-falling support plate 2, anti-falling locking column 3, first regulation hole 11, second regulation hole 12, adsorption piece 50, anti-falling knob 4, first adsorption piece 51, second adsorption piece 52, expansion hole plate 6, gear position adjustment assembly 70, expansion fixing hole 61, adjustment fixing hole 62, first adsorption head 511, first lock screw 512, first lock nut 513, second adsorption head 521, second lock screw 522, second lock nut 523, gear position hole 71, spring bead 72, bead groove 73, third regulation hole 13, fourth regulation hole 14, first shaft hole 21, second shaft hole 41, damping rotating shaft 8, height adjusting washer 514, damping screw 81, damping gasket 82, damping nut 83, outer damping groove 42, inner damping groove 22, arc-shaped protrusion 23, lock screw 31, support rubber sleeve 32, locking nut 33, and embedded groove 321.

DETAILED DESCRIPTIONS OF THE EMBODIMENTS

The present disclosure will be further described below with reference to the accompanying drawings and specific implementations. It should be noted that, various embodiments or technical features described below can be arbitrarily combined to form new embodiments without conflicts.

Figure 2:
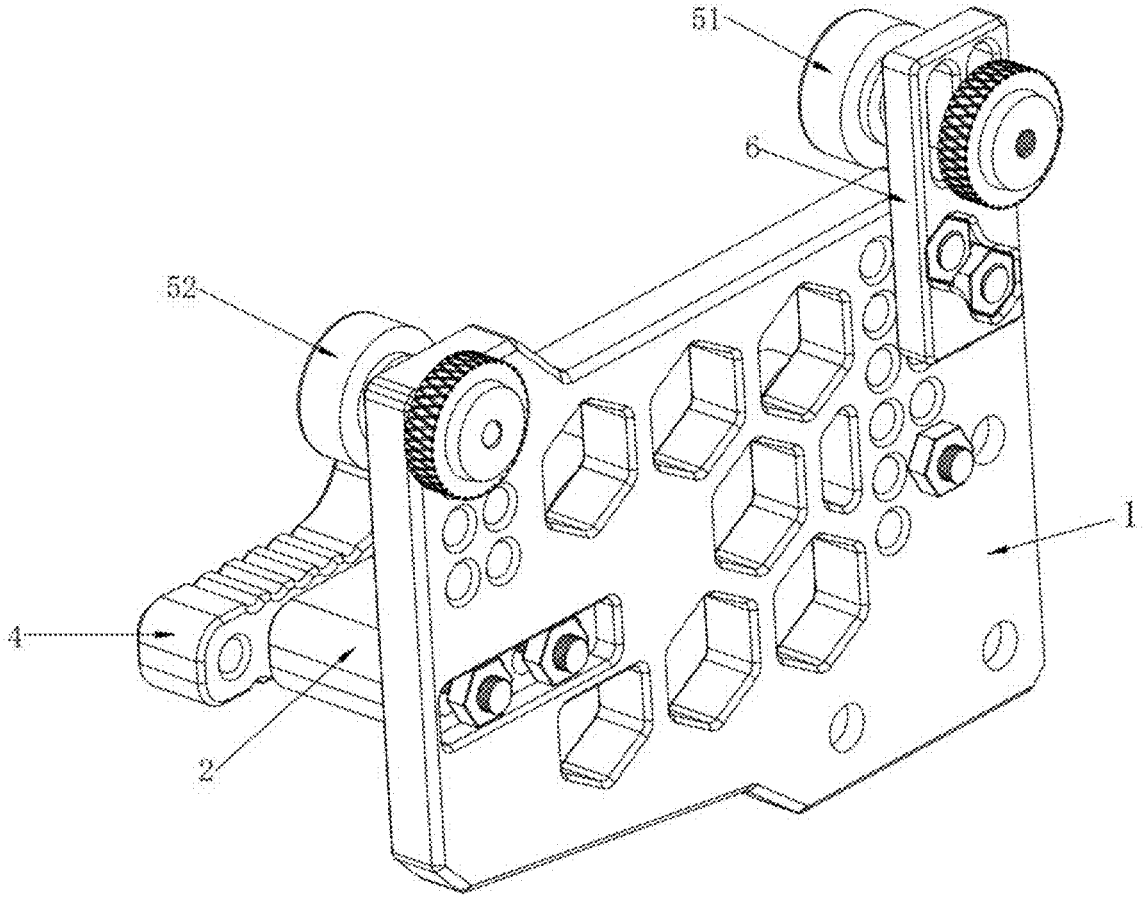
FIG. 2 is a three-dimensional schematic diagram II of an overall structure of an access device of the present disclosure.
Figure 3:
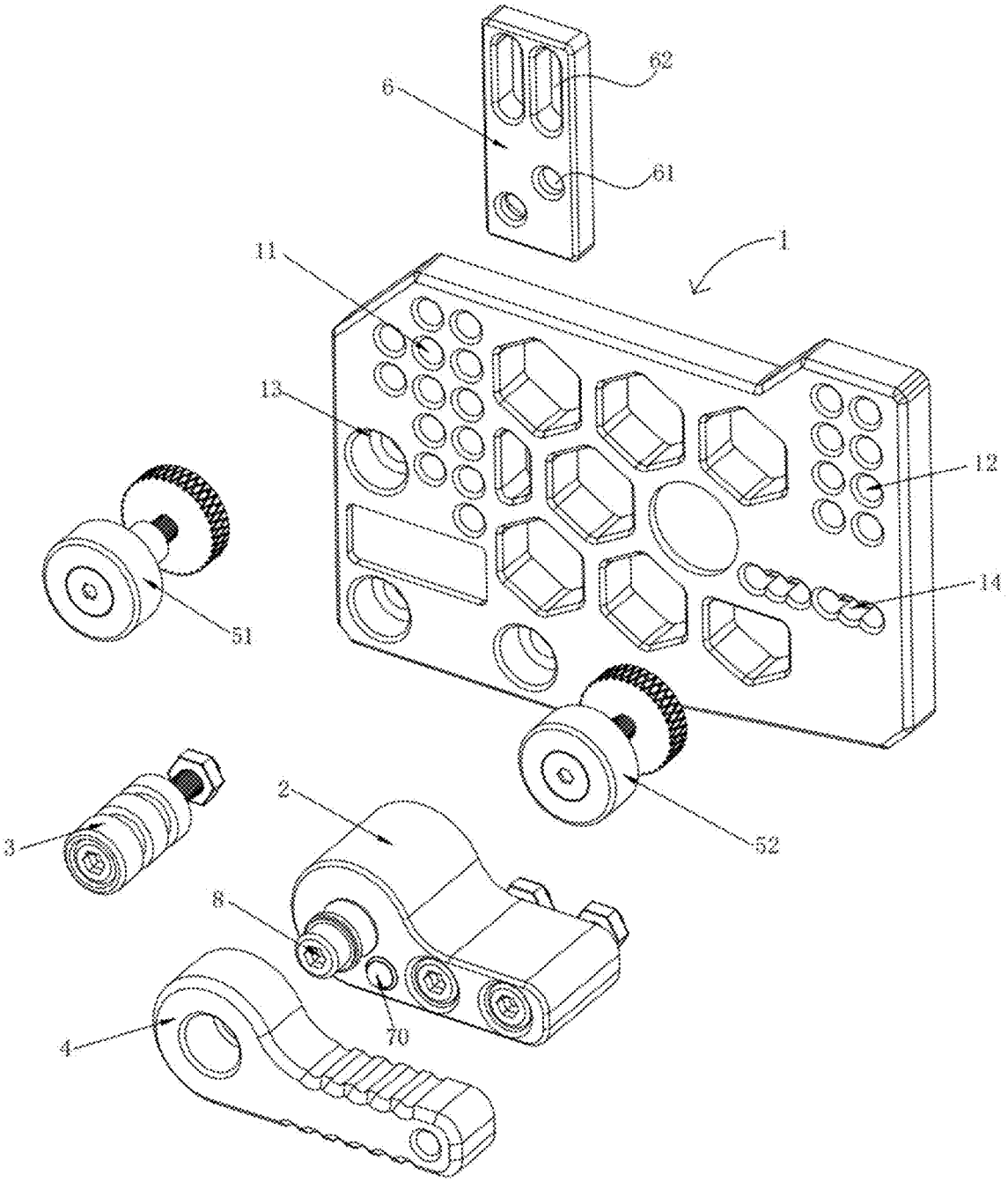
FIG. 3 is an exploded view of the overall structure of the access device of the present disclosure in FIG. 1.
Figure 4:
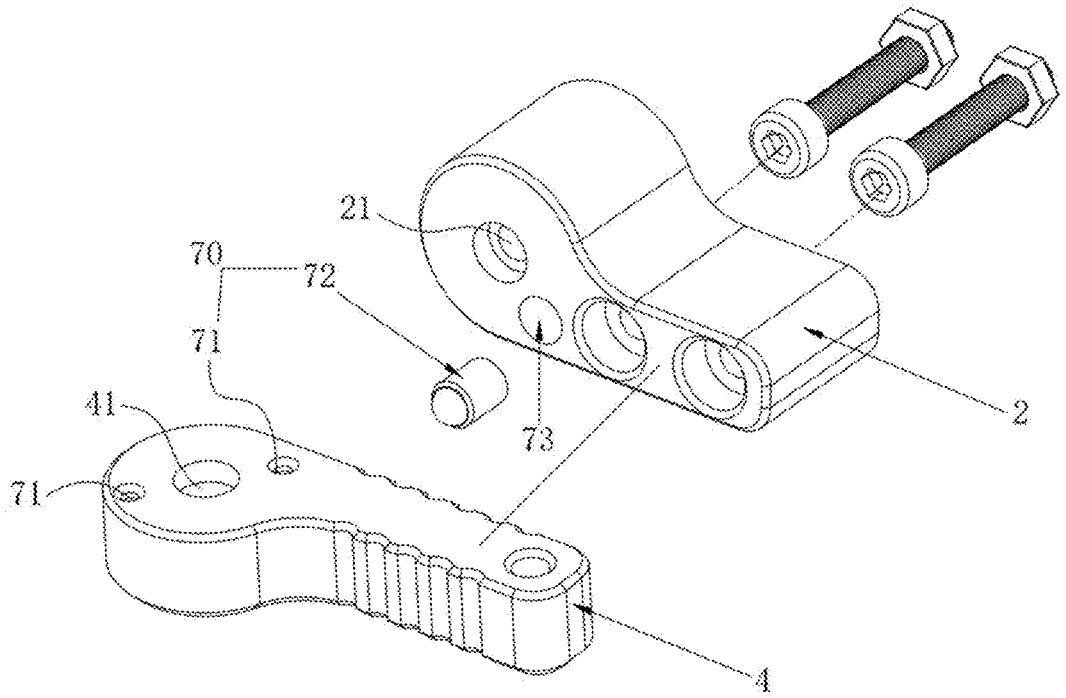
FIG. 4 is an exploded view of an anti-falling support plate, an anti-falling knob, and a gear position adjustment assembly.
Figure 5:
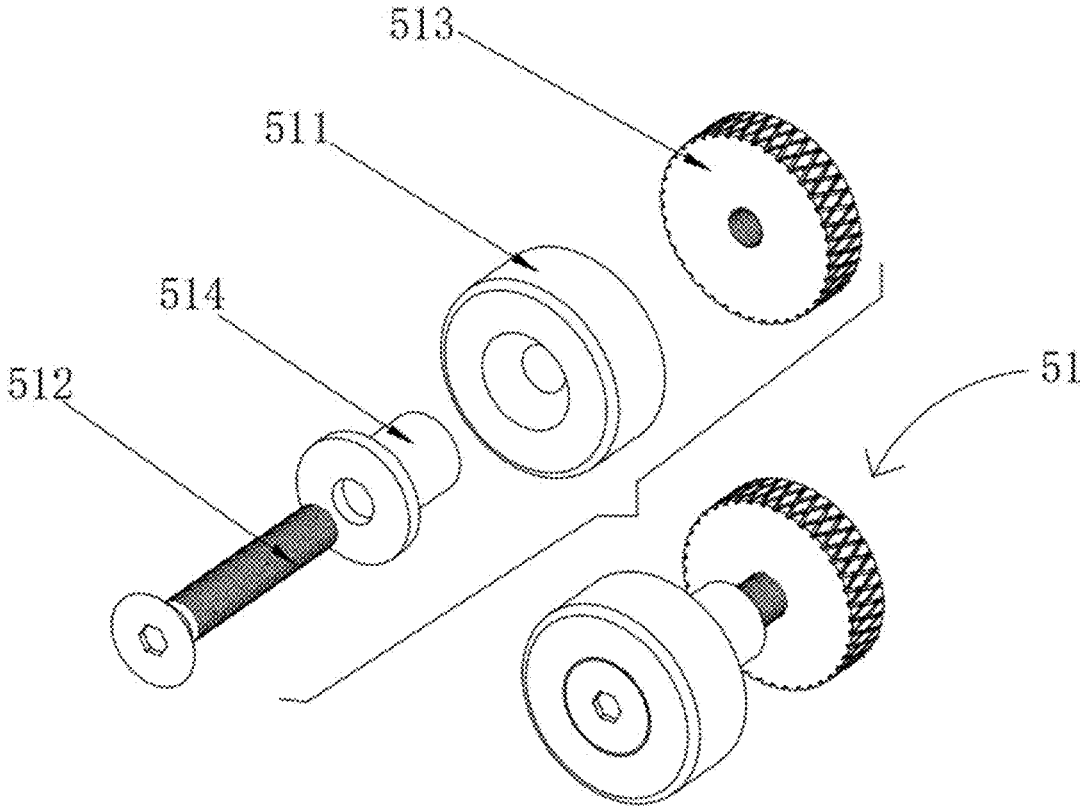
FIG. 5 is an exploded view of a first adsorption piece.
Figure 6:
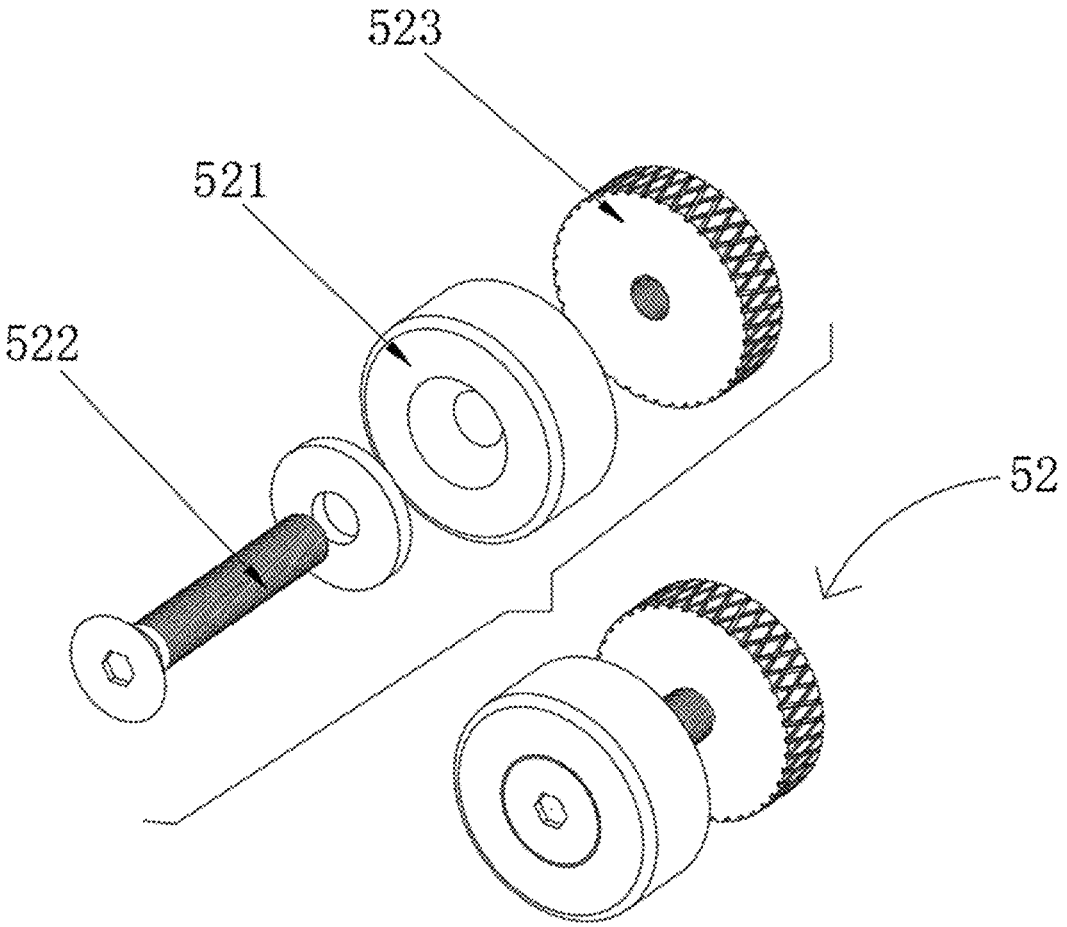
FIG. 6 is an exploded view of a second adsorption piece.
Figure 7:
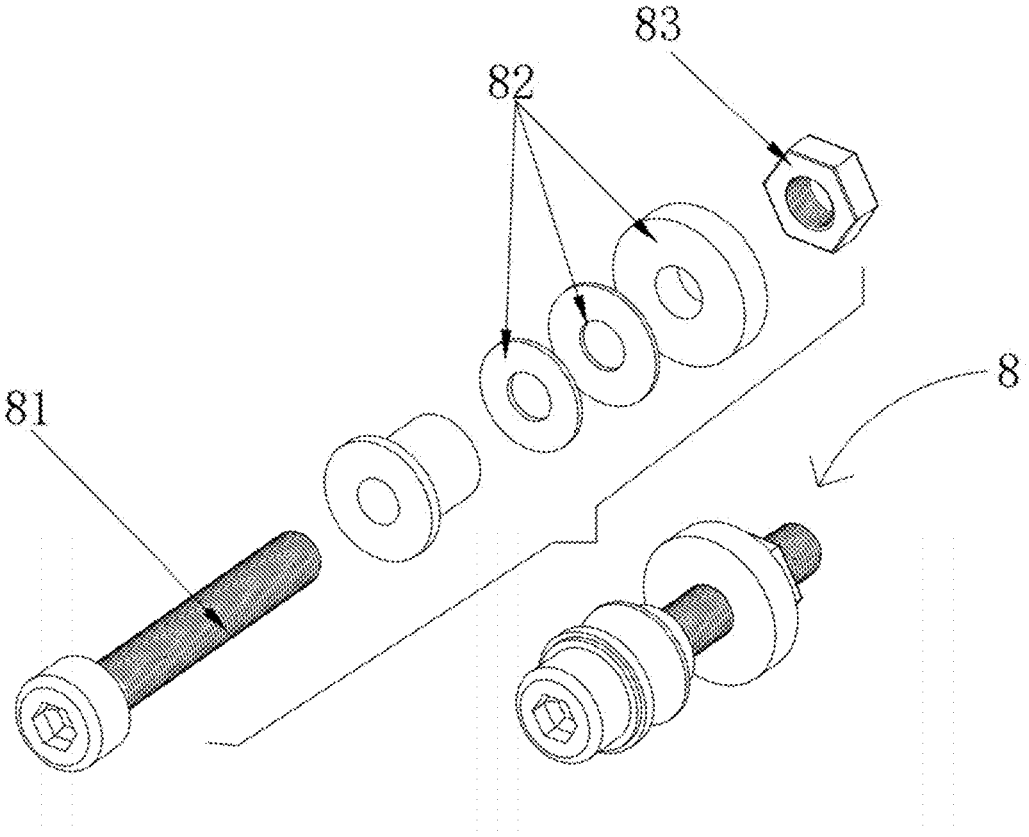
FIG. 7 is an exploded view of a structure of a damping rotating shaft.
Figure 8:
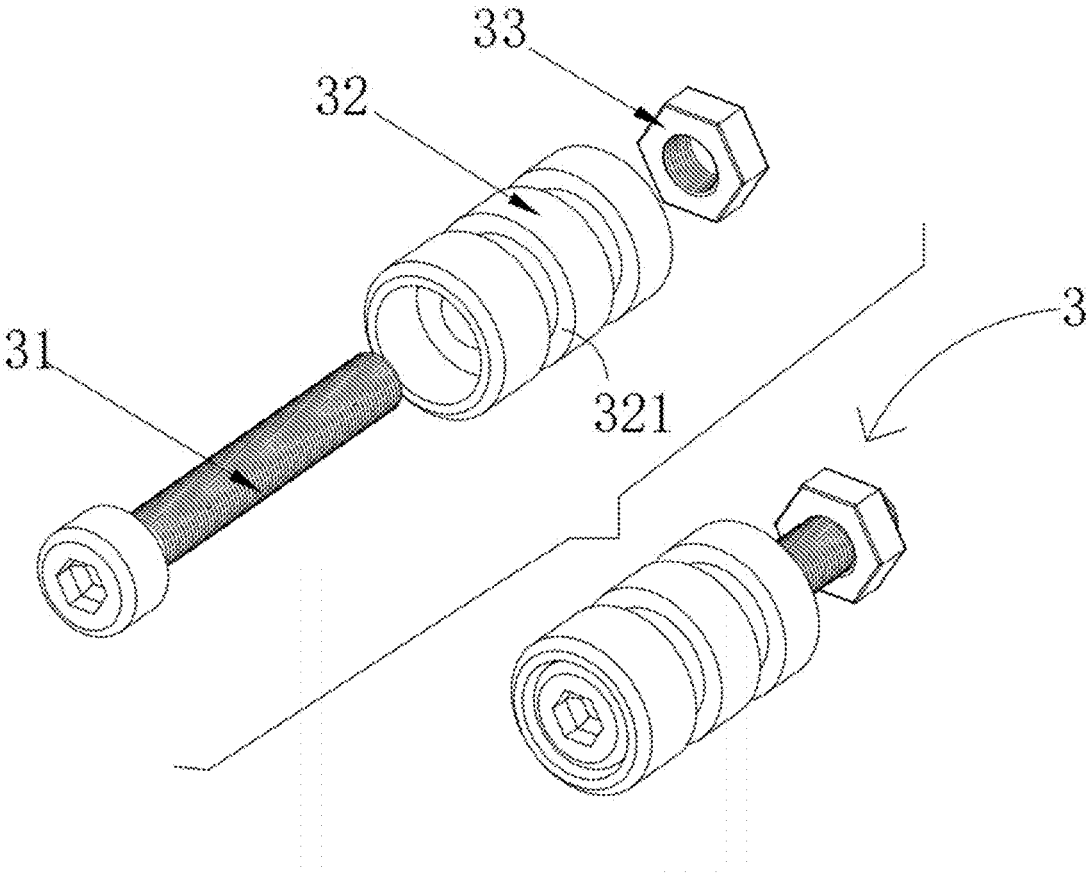
FIG. 8 is an exploded view of a structure of an anti-falling locking column.
Figure 9:
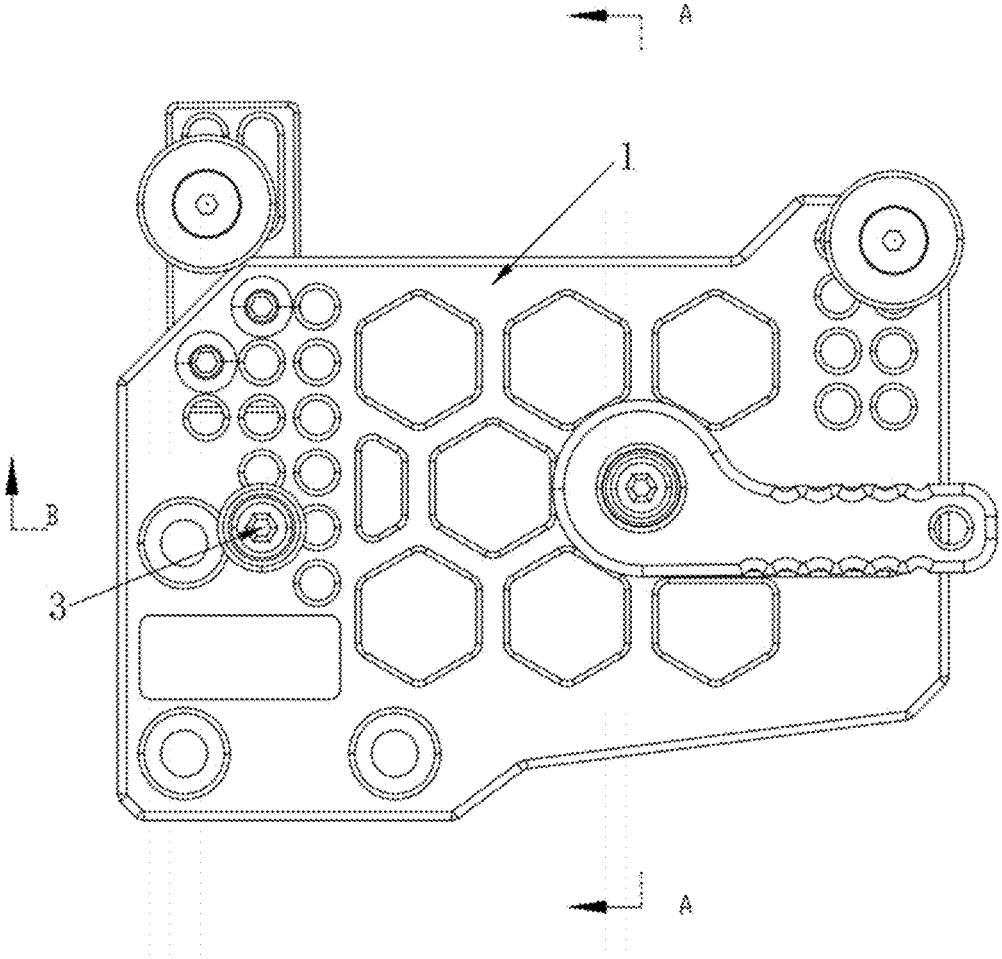
FIG. 9 is a front view of an overall structure of an access device of the present disclosure.
Figure 10:
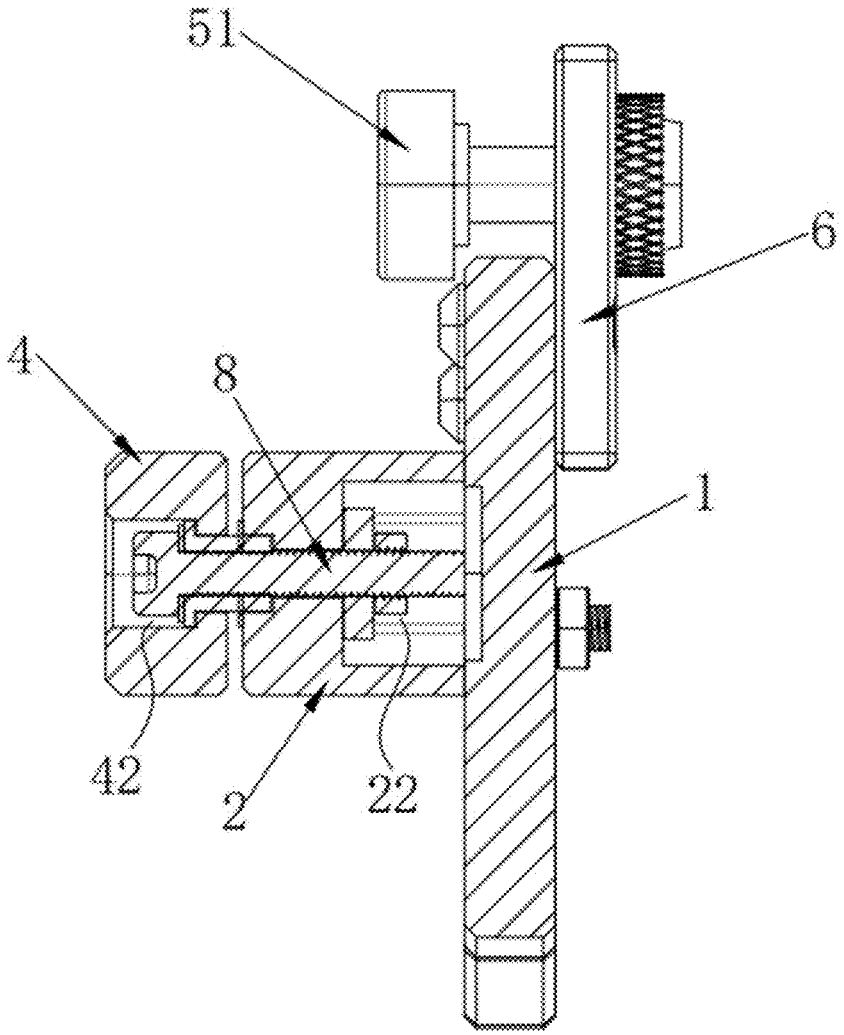
FIG. 10 is a sectional view of a breakdown structure in an A-A direction in FIG. 9.
Figure 11:
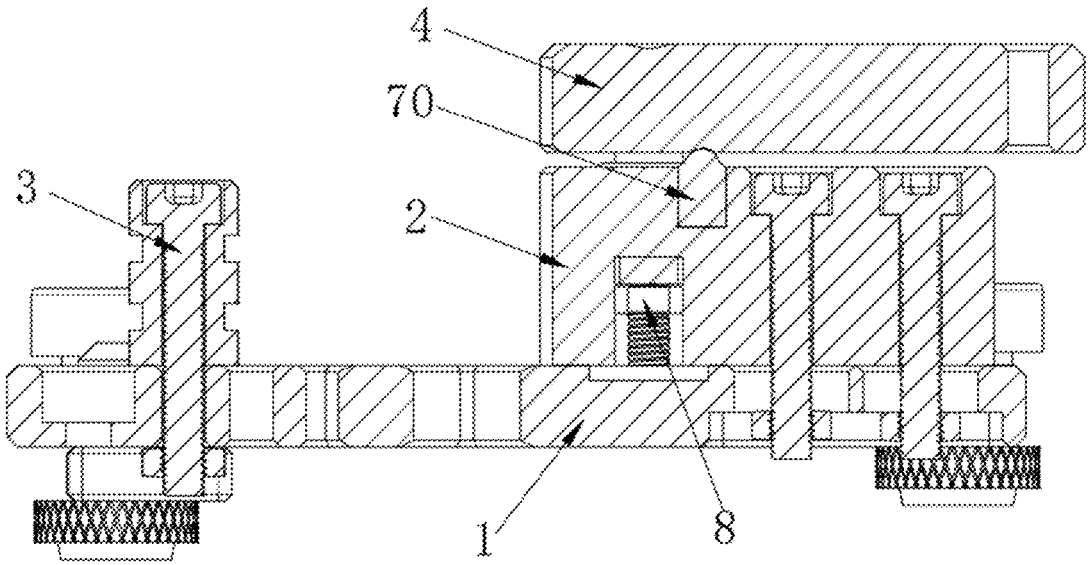
FIG. 11 is a sectional view of a breakdown structure in a B-B direction in FIG. 9.

Referring to FIGS. 1-11:

The present disclosure discloses a rapid access device for compound bow release aids, and the rapid access device includes a modular mounting mainboard 1, an anti-falling support plate 2, an anti-falling locking column 3, first regulation holes 11, second regulation holes 12 and an adsorption piece 50 that are sequentially mounted on the modular mounting mainboard 1, where the anti-falling support plate 2 and the second regulation holes 12 are located on a right side of the modular mounting mainboard 1. An anti-falling knob 4 and the first regulation holes 11 are located on a left side of the modular mounting mainboard 1. Both the first regulation holes 11 and the second regulation holes 12 are a plurality of fixing holes arranged in an array, and the arrangement of the fixing holes can be changed according to a size and a shape of the modular mounting mainboard 1. Specifically, the anti-falling support plate 2 is provided with an arc-shaped protrusion 23 designed to lift an arc-shaped part of a main body of a compound bow release aid. The anti-falling support plate 2 is distributed horizontally to support a main weight of the compound bow release aid in a maximum area. The anti-falling knob 4 is rotatably mounted on the anti-falling support plate 2, and the anti-falling knob 4 is configured for tightly locking the compound bow release aid in place in a way of rotating, thereby preventing the compound bow release aid from falling. A thickness of the anti-falling support plate 2 is slightly greater than a thickness of the compound bow release aid. The adsorption piece 50 includes a first adsorption piece 51 and a second adsorption piece 52, where the first adsorption piece 51 and the second adsorption piece 52 are preferably strong magnetic components. To expand an adjustment range of the first adsorption piece 51 for adsorbing at an overwhelming majority of trigger or switch positions of the compound bow release aid, an expansion hole plate 6 is mounted at a position of the first regulation holes 11, the first adsorption piece 51 is mounted on the expansion hole plate 6, and the second adsorption piece 52 is mounted at a position above the second regulation holes 12. A gear position adjustment assembly 70 capable of adjusting a position of the anti-falling knob 4 relative to the anti-falling support plate 2 is further mounted between the anti-falling knob 4 and the anti-falling support plate 2.

Specifically, the expansion hole plate 6 includes expansion fixing holes 61 and adjustment fixing holes 62, where the expansion fixing holes 61 are configured for fitting with the first regulation holes 11 through fixing bolts during mounting, and the adjustment fixing holes 62 are configured for fitting with the first adsorption piece 51 during mounting. The first adsorption piece 51 includes a first adsorption head 511, a first lock screw 512, and a first lock nut 513. The second adsorption piece 52 includes a second adsorption head 521, a second lock screw 522, and a second lock nut 523. Both the first adsorption head 511 and the second adsorption head 521 are strong magnetic components. During mounting, the first lock screw 512 sequentially penetrates through the first adsorption head 511, the adjustment fixing hole 62, and the first lock nut 513 to complete the mounting of the first adsorption piece 51. The second lock screw 522 sequentially penetrates through the second adsorption head 521, the second regulation hole 12, and the second lock nut 523 to complete the mounting of the second adsorption piece 52. When a user finds any mismatch in position when placing the compound bow release aid on the rapid access device, positions of the first adsorption piece 51 and the second adsorption piece 52 can be adjusted to achieve the purpose of fitting.

Specifically, the anti-falling knob 4 on the anti-falling support plate 2 rotates mainly by means of a damping rotating shaft 8. Without a function of gear position control, the user can only rotate the anti-falling knob 4 by feeling, resulting in lack of a unified standard for determining rotation angles, that is, it is unclear about an optimal rotation angle for locking the main body of the compound bow release aid. In view of this, a technical solution is provided: the gear position adjustment assembly 70 includes gear position holes 71 and a spring bead 72, a bead groove 73 is formed at an upper end of the anti-falling support plate 2, and the spring bead 72 is mounted in the bead groove 73. A plurality of the gear position holes 71 are formed at a lower end of the anti-falling knob 4, an output end of the spring bead 72 is capable of abutting against the corresponding gear position hole 71 when the anti-falling knob 4 rotates, and when the anti-falling knob 4 rotates, a ticking sound is produced, indicating that a desired position is reached. Preferably, the number of the gear position holes 71 is set as two for unlocking and locking respectively. The gear position hole 71 for unlocking corresponds to a state where the anti-falling knob 4 is just flush with the anti-falling support plate 2, i.e., in this state, the anti-falling knob 4 does not block the compound bow release aid. The gear position hole 71 for locking corresponds to an included angle formed between the anti-falling knob 4 and the anti-falling support plate 2, and at the included angle, most part of the anti-falling knob 4 blocks a compound bow release aid clamped on an inner side of the anti-falling knob 4. Therefore, the user only needs to rotate the anti-falling knob 4 by two gear positions to complete locking and unlocking respectively, which is very convenient.

To further modularize hole positions on the modular mounting mainboard 1, third regulation holes 13 and fourth regulation holes 14 are further included, where the third regulation holes 13 are located below the first regulation holes 11, the fourth regulation holes 14 are located below the second regulation holes 12, the third regulation holes 13 are configured for fitted adjustment and mounting of the anti-falling locking column 3, and the fourth regulation holes 14 are configured for the fitted adjustment and mounting of the anti-falling support plate 2.

Specifically, the fourth regulation holes 14 include a plurality of fixing holes arranged horizontally, the anti-falling support plate 2 horizontally arranged can be adjusted horizontally from left to right at positions of the fourth regulation holes 14 distributed horizontally to match compound bow release aids of different widths or solve the problem that concave-convex portions of cambered surfaces of different compound bow release aids are arranged on different horizontal lines. A support plate fixing hole is formed in the anti-falling support plate 2, and a bolt penetrates through the support plate fixing hole and the corresponding fourth regulation hole 14 to fix the anti-falling support plate 2 on the modular mounting mainboard 1. A first shaft hole 21 is formed on a side of the anti-falling support plate 2 in a penetrating manner, a second shaft hole 41 is formed at a position where the anti-falling knob 4 corresponds to the first shaft hole 21, and the damping rotating shaft 8 sequentially penetrates through the first shaft hole 21 and the second shaft hole 41 to complete damping-type rotation mounting of the anti-falling knob 4 and the anti-falling support plate 2.

Specifically, the expansion hole plate 6 is mounted at a lower end of the modular mounting mainboard 1, and an end face of the expansion hole plate 6 is not aligned with an end face of the modular mounting mainboard 1, such that adsorption heads of the first adsorption piece 51 and the second adsorption piece 52 may not be on a same plane after mounting. Therefore, for a compound bow release aid where a trigger and a hook are on a same plane, the first adsorption piece 51 cannot directly adsorb at a trigger position. In view of this, a technical solution is provided: the first adsorption piece 51 further includes a height adjusting washer 514, and the height adjusting washer 514 is arranged between the first adsorption head 511 and the expansion hole plate 6 and is sleeved on an outer side of the first lock screw 512, such that the height adjusting washers 514 of different heights can be added based on an amplitude of deviation between the trigger and the hook of the compound bow release aid.

Specifically, the damping rotating shaft 8 includes a damping screw 81, damping gaskets 82, an outer damping groove 42, an inner damping groove 22, and a damping nut 83. The outer damping groove 42 is formed on an outer side of the anti-falling knob 4, and the inner damping groove 22 is formed on an inner side of the anti-falling support plate 2. A plurality of the damping gaskets 82 are respectively located at positions between the outer damping groove 42, the inner damping groove 22, the anti-falling support plate 2 and the anti-falling knob 4. The damping screw 81 sequentially penetrates through the first shaft hole 21, the second shaft hole 41, and the corresponding damping gasket 82 to complete the mounting of the damping rotating shaft 8. Some gaskets in front, middle and rear portions of the damping rotating shaft 8 always rotate in a damping manner, thereby increasing resistance to damping rotation of the damping rotating shaft 8 and preventing auto rotation of the anti-falling knob 4. Further, in combination with the spring bead 72 and the gear position holes 71 in the gear position adjustment assembly 70, the resistance to the damping rotation of the anti-falling knob 4 is further increased, such that manual rotation is required for rotating.

Specifically, the anti-falling locking column 3 includes a lock screw 31, a support rubber sleeve 32 and a locking nut 33, and an embedded groove 321 is formed in the support rubber sleeve 32 and is configured for fitting an edge or a middle portion protruding on the main body of the compound bow release aid in an embedded manner.

Specifically, for the expansion hole plate 6, single-direction slot holes may be insufficient to ensure that the first adsorption piece 51 is adjusted in horizontal, vertical and diagonal directions. Either of the adjustment fixing holes 62 is one of a long slot hole, a curved slot hole, or a V-shaped slot hole. The long slot hole may be a horizontal or vertical slot hole, and the curved slot hole or the V-shaped slot hole is capable of assisting the first adsorption piece 51 in adjusting in the diagonal direction. Further, the first regulation holes 11 are array-type fixing holes, such that a relative position of the expansion hole plate 6 on the modular mounting mainboard 1, through the first regulation holes 11, can be adjusted in horizontal, vertical and rotational directions, thereby enlarging an adjustment range for the first adsorption piece 51 significantly.

Specifically, the anti-falling support plate 2 is provided with the arc-shaped protrusion 23 designed to lift the arc-shaped part of the main body of the compound bow release aid.

The above implementations are merely preferred implementations of this present disclosure and are not intended to limit the scope of protection of the present disclosure. Any non-substantial changes and substitutions made by those skilled in the art based on the present disclosure fall within the scope of protection of the present disclosure.

What is claimed is:

1. A rapid access device for compound bow release aids, comprising a modular mounting mainboard, an anti-falling support plate, an anti-falling locking column, first regulation holes, second regulation holes and an adsorption piece that are sequentially mounted on the modular mounting mainboard, wherein an anti-falling knob is rotatably mounted on the anti-falling support plate: the adsorption piece comprises a first adsorption piece and a second adsorption piece, an expansion hole plate is mounted at a position of the first regulation holes, the first adsorption piece is mounted on the expansion hole plate, the second adsorption piece is mounted at a position above the second regulation holes, and a gear position adjustment assembly capable of adjusting a position of the anti-falling knob relative to the anti-falling support plate is further mounted between the anti-falling knob and the anti-falling support plate.

2. The rapid access device for compound bow release aids according to claim 1, wherein the expansion hole plate comprises expansion fixing holes and adjustment fixing holes, wherein the expansion fixing holes are configured for fitting with the first regulation holes during mounting, and the adjustment fixing holes are configured for fitting with the first adsorption piece during mounting; the first adsorption piece comprises a first adsorption head, a first lock screw, and a first lock nut; and the second adsorption piece comprises a second adsorption head, a second lock screw, and a second lock nut, wherein both the first adsorption head and the second adsorption head are strong magnetic components.

3. The rapid access device for compound bow release aids according to claim 2, wherein the first adsorption piece further comprises a height adjusting washer, and the height adjusting washer is arranged between the first adsorption head and the expansion hole plate and is sleeved on an outer side of the first lock screw.

4. The rapid access device for compound bow release aids according to claim 2, wherein either of the adjustment fixing holes is one of a long slot hole, a curved slot hole, or a V-shaped slot hole.

5. The rapid access device for compound bow release aids according to claim 1, wherein the gear position adjustment assembly comprises gear position holes and a spring bead, a bead groove is formed at an upper end of the anti-falling support plate, and the spring bead is mounted in the bead groove; and a plurality of the gear position holes are formed at a lower end of the anti-falling knob, and an output end of the spring bead is capable of abutting against the corresponding gear position hole when the anti-falling knob rotates.

6. The rapid access device for compound bow release aids according to claim 1, wherein third regulation holes and fourth regulation holes are further comprised, wherein the third regulation holes are located on a side of the first regulation holes, the fourth regulation holes are located on a side of the second regulation holes, the third regulation holes are configured for fitted adjustment and mounting of the anti-falling locking column, and the fourth regulation holes are configured for the fitted adjustment and mounting of the anti-falling support plate.

7. The rapid access device for compound bow release aids according to claim 6, wherein the fourth regulation holes comprise a plurality of fixing holes arranged horizontally, a support plate fixing hole is formed in the anti-falling support plate, and a bolt penetrates through the support plate fixing hole and the corresponding fourth regulation hole to fix the anti-falling support plate on the modular mounting mainboard; and a first shaft hole is formed on a side of the anti-falling support plate in a penetrating manner, a second shaft hole is formed at a position where the anti-falling knob corresponds to the first shaft hole, and a damping rotating shaft sequentially penetrates through the first shaft hole and the second shaft hole to complete damping-type rotation mounting of the anti-falling knob and the anti-falling support plate.

8. The rapid access device for compound bow release aids according to claim 7, wherein the damping rotating shaft comprises a damping screw, damping gaskets, an outer damping groove, an inner damping groove, and a damping nut; the outer damping groove is formed on an outer side of the anti-falling knob, and the inner damping groove is formed on an inner side of the anti-falling support plate; a plurality of the damping gaskets are respectively located at positions between the outer damping groove, the inner damping groove, the anti-falling support plate and the anti-falling knob; and the damping screw sequentially penetrates through the first shaft hole, the second shaft hole, and the corresponding damping gasket to complete the mounting of the damping rotating shaft.

9. The rapid access device for compound bow release aids according to claim 1, wherein the anti-falling locking column comprises a lock screw, a support rubber sleeve and a locking nut, and an embedded groove is formed in the support rubber sleeve and is configured for fitting an edge or a middle portion protruding on a main body of a compound bow release aid in an embedded manner.

10. The rapid access device for compound bow release aids according to claim 1, wherein the anti-falling support plate is provided with the arc-shaped protrusion designed to lift an arc-shaped part of the main body of the compound bow release aid.

* * * * *